United States Patent [19]

Schippers et al.

[11] 4,118,843

[45] Oct. 10, 1978

[54] PROCESSES AND APPARATUS FOR THERMAL TREATMENT OF FILAMENTS

[75] Inventors: Heinz Schippers; Peter Dammann; Karl Bauer, all of Remscheid, Germany

[73] Assignee: Barmag Barmer Maschinenfabrik Aktiengesellschaft, Remscheid-Lennep, Germany

[21] Appl. No.: 815,228

[22] Filed: Jul. 13, 1977

[51] Int. Cl.[2] ..... D02G 1/12; D02G 1/16; D02G 1/20

[52] U.S. Cl. ..... 28/255; 28/258; 28/266

[58] Field of Search ..... 28/254, 255, 256, 257, 28/271, 263, 266, 268, 258

[56] References Cited

U.S. PATENT DOCUMENTS

| | | | |
|---|---|---|---|
| 2,886,877 | 5/1959 | Frickert | 28/271 X |
| 3,298,079 | 1/1967 | Agett et al. | 28/266 |
| 3,359,609 | 12/1967 | Iwnicki et al. | 28/264 |
| 3,469,293 | 9/1969 | Tsuzimoto et al. | 28/266 |
| 3,911,538 | 10/1975 | Vidal et al. | 28/255 |

*Primary Examiner*—Louis K. Rimrodt

*Attorney, Agent, or Firm*—Keil, Thompson & Shurtleff

[57] ABSTRACT

Apparatus and process for thermal treatment of thermoplastic polymer multifile filaments embodying at least one stuffing chamber for forming at least one multifile filament into at least one tightly coherently packed filamentary body, feeding one or more of said filamentary bodies onto gas-permeable, slowly rotating drum on which it or they are conveyed in a side-by-side, spiral orientation by the rotating drum while a fluid, e.g., air is drawn through the filamentary bodies, said filamentary bodies being conveyed from the stuffing chamber at a constant rate and being deflected at a predetermined pitch angle before or during initial contact with the drum surface.

27 Claims, 6 Drawing Figures

PROCESSES AND APPARATUS FOR THERMAL TREATMENT OF FILAMENTS

In the thermal treatment of multifile, synthetic filaments and fibers there must be, on the one hand, a sufficient intensity of the heating or cooling, and, on the other hand, also an absolute uniformity thereof over the length of the filaments. Both requirements demand as long as possible a staying time for the achievement of the intended uniform thermal state of the filaments. The length of the staying time, in turn, is opposed to the goals of increase of the production speed.

In one known arrangement used in a texturizing apparatus the filaments of the thermal treatment are deposited in a groove on the circumference of a rotating roller in the form of a continuous body of tightly crimped filaments. The groove runs circumferentially of the roller and has openings in the zone of its groove base through which air or other gases are sucked into the interior of the rotating roller. The filamentary body should cling closely to the groove walls, and the treatment medium simultaneously must flow through the body (German Offen. No. 2,236,024).

The disadvantage of the known apparatus is, among other things, that the roller must have a large diameter so that sufficiently long staying times are attained. It is also a disadvantage that the blowing nozzles are directed into the groove and the filaments are not supplied in a uniform configuration to the thermal treatment zone, i.e., especially during a cooling treatment.

The object of the invention is, for the thermal treatment of multifile, synthetic filaments, to provide a process and an apparatus in which the tightly coherently packed filamentary body formed in a stuffing chamber is deposited in a continuously uniform form on a rotating treatment drum. Here at least one filamentary body is contacted by a heating or cooling fluid without a critical dependence between drum diameter and staying time. A sufficient staying time is assured with only a small diameter of the treatment drum even for increased production speeds. The process and the apparatus are useful especially for tension-free filament treatment in texturizing operations.

The process embodies the thermal treatment of one or more multifile, synthetic polymer filaments in the form of at least one tightly coherently packed, filamentary body on a rotating, gaspermeable drum while drawing a gas through the filamentary body or bodies. The characteristics of the process include: forming one or more of said filamentary bodies in a stuffing chamber or chambers; conveying each still coherently packed body from the stuffing chamber(s) onto the rotating drum surface at a constant rate (V2) at a pitch angle providing a thrust component or vector which is parallel to the axis of rotation of the drum. The filamentary body or bodies are wound several times around the drum in substantially spiral, side-by-side fashion, and the side-by-side spirals cover substantially the entire gas permeable surface of the drum. At the outlet zone of the drum, the filaments are drawn off the drum surface with the resolution or disappearance of their tightly packed state.

Two or more stuffing chambers may be used in association with a single, gas permeable drum, in which case the individual tightly coherently packed filamentary bodies are fed side-by-side onto the inlet side of the drum with the aforesaid thrust directions and are conveyed in the form of side-by-side spirals by the drum to its outlet end, where the filaments are drawn off in parallel.

The drum preferably is driven at a circumferential velocity V3 which is less than the axial velocity V1 at which the filaments are fed into the stuffing chamber. The preferred relationship of V3 and V1 is expressed by the formula:

$$V3/V1 = 1.42 \times 10^{-4} \times (\text{den}/P\,\gamma\,D^2)$$

in which

*den* = denier of the multifile filament in g/9,000 meters $\gamma$ = specific weight of the multifile filament in kg/1000cm$^3$ $D$ = diameter of the stuffing chamber in mm $P$ = packing density of the packed filamentary body with $P<1$.

If the packing density of each filamentary body as achieved in the stuffing chamber is to be made less dense for the treatment on the rotating drum, the latter may be driven at a peripheral velocity V3 greater than that prescribed by the above equation. Further, there may be interposed between the stuffing chamber and the rotating drum conveyance rolls which impart a positive conveyance to each filamentary body exiting from the stuffing chamber(s).

In a futher variation of the invention, the zone about the drum may be divided in the axial direction of the drum into separate, successive annular zones through which different gas treatment media (e.g., different temperatures, and/or different gases) are drawn through the still closely packed filamentary body or bodies being conveyed by the drum.

The filaments are drawn off the exit end of the rotating drum at a velocity V4 which is less than V1 and to which the following parameters apply:

$$V3 << V4 < V1$$

and $$V4 = K \cdot V1,\ K = \text{crimp contraction.}$$

Other adaptations of the invention include feeding the packed filamentary body axially parallel to the axis of the drum and deflecting it to the pitch angle of the spiral path of the body about the drum as the body approaches the feed end of the drum. Another feature involves a stuffing chamber or a discharge passage thereof of square transverse cross-section to provide a filamentary body of like transverse cross-section.

The innovative apparatus features of the invention include the combination of stuffing chamber(s), feed rolls, the perforated, gas permeable cylindrical or frusto-conically tapered drum, and draw-off mechanisms at the exit end of the drum. The drum has a smooth, perforated, cylindrical or tapered surface. In the zone of its entrant or feed end, it has a stationary, deflecting member adapted to cause the filamentary body or bodies to assume a spiral path about the drum at a pitch whose dimension is equal to or less than the sum of the diameters (or side length of a square) of the stuffing chamber(s) allocated to each rotating drum. Such deflecting member preferably is a fixed shoe or plate extending spirally toward the exit end of the drum and curvately about part of the circumference of the drum in the direction of movement of the contiguous drum surface.

One or more annular chambers having an opening facing the drum may surround the perforated portion of the drum, through which chamber(s) the gas treatment media are supplied and drawn into the drum through its perforations. Such chamber(s) may have the annular wall opposite the drum surface spaced to provide an annular spacing having a depth equal to, slightly smaller than or slightly larger than the diameter or depth of the filamentary body or bodies on the drum.

An air permeable shell about the drum may have a collar or flange projecting beyond its circumference. A roller or rollers, during the rotation of the shell with the drum, rolls against the annular face of the collar or flange. Such shell may be loosely mounted about the drum and may rest on a support surface which approximately centers the feed end of the shell during the starting of the apparatus.

The process can also be used advantageously for several filaments to be treated and, in particular, to be texturized, the advantage being especially that, through the simultaneous thermal treatment on a treatment drum, there is achievable, not only a homogeneity of the product over the filament length, but also from filament to filament.

The packing density of the filamentary body or bodies attained in the stuffing chamber is dependent especially on the flow speed and the temperature of the treatment medium, particularly of the heated air. In texturizing, the packing density and the crimping properties (if desired) to be achieved stand in a certain relation, in which the fundamental tendency exists that a greater packing density yields also a more intensive crimping. The greater packing density brings about, however, a higher choke resistance with respect to the gases traversing the filamentary body for the thermal treatment. There arises, therefore, with increasing packing density the danger that the thermal treatment is not homogeneous over the cross-section of the filamentary body. For the avoidance of this disadvantage the packing density may be reduced by the above-described greater relative velocity of the drum surface. The positive conveyance of the filamentary body provides, in addition, the frequently desirable and advantageous possibility, through choice of the positive conveyance speed greater or less than or equal to the supply speed V2 or the drum speed V3, to densify or to thin the packing of the filaments before or after the positive conveyance. Depending on conditions in the stuffing chamber, mainly temperature and degree of packing density, the multifile filament may or may not have crimps formed therein.

The process of the invention is executed by connecting the treatment drum to a suction device. Through the choke resistance offered by the filamentary body deposited in at least several spirals on the perforated part of the drum wall, the body is held fast on the drum wall. The gas, therefore fulfills two functions, i.e,. in the first place that of holding the filamentary body fast on the drum wall and, in the second place, the function of the thermal treatment. The thermal treatment for the cooling takes place preferably by using room air. It is possible, and in many cases advantageous, however, also to draw various treatment gases in successive zones as viewed in axial direction of the treatment. Here, there can be a heating by heated air or heated steam and then a cooling by drawing in room air.

The filamentary body may have a rectangular (square) transverse cross-section. This can be achieved by stuffing the filaments in a rectangular cross-section stuffing chamber or reshaping a cylindrically-formed filamentary body in the stuffer's discharge passage or in the roller gap of conveyor rolls situated after the stuffer. Such rectangular shape gives uniformity to the choke resistance, by which the filamentary body opposes the through-flowing gas, over the entire length of the body on the treatment drum and thereby an improvement of the thermal treatment.

The apparatus for the execution of the process of the invention is distinguished especially by the feature that it has—as seen in axial direction—smooth walls. Thereby it is assured that the filamentary body deposited in the circumferential direction of movement of the drum at a low pitch on the orbiting circumference of the treatment drum can be shifted axially parallel to the drum axis, which shifting is brought about by a stationary deflecting feed device. This device, which can extend over a part of or the entire drum circumference, with reference to the direction of rotation of the drum, has a shift (pitch) parallel to the drum axis which corresponds substantially to the diameter of the stuffing chamber (or the side length of a square cross-sectioned chamber) or is somewhat smaller, whereby it is assured that the convolutions of the filamentary body or bodies are laid densely next to one another in touching relationship. If several filamentary bodies are to be deposited on the treatment drum in parallel spirals, the axial shift corresponds to the sum of the diameters or side lengths of the stuffing chambers, or for the achievement of a sufficiently dense contact of the individual windings, preferably is slightly smaller than such sum. The axial shift device also can be a rotatable roller with a stationary axis at the inlet zone of the drum with a slight spacing relative to the drum surface.

The treatment drum is cylindrical or slightly frustoconical. A frusto-conical drum with a smaller outlet end facilitates the axial shifting of the filamentary body. A frustoconical drum with larger outlet end is advantageous in order to reduce the packing density of the filamentary body during the axial shift to increase the permeability to gas.

It is emphasized that the thermal treatment according to this invention is applicable to the texturizing of multifile, synthetic polymer, thermoplastic filaments, in which a filament is conveyed through a texturizing nozzle charged with hot air into a cylindrical stuffing chamber and is formed therein into a tightly coherently packed, filamentary body and is conducted in this form out of the stuffing chamber. The invention is, however, also usable in the usual stuffing-crimping processes, in which filaments are compacted between compression rolls into tightly crimped form (for example, German examined patent specification AS No. 1,265,912). It is further to be mentioned that in a stuffing chamber one or more multifile filaments can be stuffed to form the packed filamentary body.

By virtue of the invention described above, the thermal treatment on the drum assures, on the one hand, a sufficient intensity of the heating or cooling of the filament or filaments of each filamentary body and, on the other hand, an absolute uniformity off the thermal treatment over the length of the filamentary body, as well as a relatively long thermal treatment at high production speed.

This process for the thermal treatment of multifile, synthetic polymer filaments has proved especially advantageous for the solution of the conflict between a sufficient residence time and the technological demands for high filament speeds, especially in the texturizing of freshly spun and/or stretched filaments in a continuous operation.

It has proved that the quality of the packed filamentary bodies and thereby also their cohesion vary in dependence on the thermal state, i.e., the thermal treatment. The filament packing may be carried out faultlessly through adjustment of the process conditions in the stuffing chamber, the conveyance rate of the packed filamentary body and the peripheral velocity of the treatment drum, but during the thermal treatment the adhesive and cohesive forces holding the tightly coherently packed body together change in such a way that partial lengths of the body have a tendency to disintegrate. On the other hand, especially in the case of too great a diameter of the treatment drum, there exists the danger that the adjoining rows of the filamentary body bend out because of the axial pressure of the positive feed devices.

In order to compensate for such tendencies, the treatment drum, at least over a part of the gas-permeable wall, may be surrounded by a gas-permeable shell, known per se, with annular space between the drum and shell. The latter rests freely on the layer of turns of the filamentary body or bodies, the inside diameter of the shell being equal to or slightly smaller or greater than the outer diameter of the layer of spiral turns.

The thermal treatment process and the apparatus according to the invention are suited, furthermore, for thermal treatments of crimped or uncrimped filaments in which absence of tension in the filaments during thermal treatment is acceptable, desirable or necessary, e.g., for fixing of a crimping previously done by air turbulence or twisting processes, for the development of the crimping of filaments having an asymmetric cross section (bicomponents among others), and for the treatment of smooth or crimped multifile filaments and the like.

Within the scope of the texturizing processes mentioned above and other processes, the process according to the invention offers for the thermal treatment several advantages. The thermal treatment of the filamentary body requires, because of the high packing density and the relatively large cross section of the body, only low axial velocities in the treatment zone. The filament(s) is formed in stuffing chamber into a configuration of uniform transverse cross section but is not subject in the thermal treatment zone to the lateral restraints present in the stuffing chamber, and therefore, can expand or shrink freely. Also, at low rates of revolution of the drum and small diameters of the drum, an efficient and homogeneous thermal treatment, especially cooling, is attainable by using many spiral turns of the body about the drum.

The process is characterized by the conveying of the filamentary body without constraints on the sides thereof, which sides touch in the side-by-side spirals about the treatment drum, and with optional constraints between the shell and the drum in the direction 90° from the sides. It is obvious that the treatment principles herein can be modified in the sense that the filamentary body lies on the inside wall of the drum and the gas flow is directed from the inside outward.

A preferred procedure for stuff-crimping or stuff-packing two or more filaments and preventing the several tightly coherently packed filamentary bodies formed in a stuffing chamber from becoming entwined, joined and felted with one another in such a way that they can no longer be separated from one another is shown in FIG. 6. The invention further provides the option of forming two or more tightly packed filamentary bodies of individual filaments parallel with one another, combining them into a composite filamentary body and after the treatment resolving the composite filamentary body again into its individual filaments. Thus, it is possible from the viewpoints of machine technology and process technology, for example, to treat four filaments simultaneously, by forming first a tightly coherently packed body of each filament, then combining two bodies each into two composite filamentary bodies and conducting the two composite bodies tangentially onto the treatment drum and then, following the treatment, resolving each composite into its two filaments.

The invention is explained further preferred embodiments illustrated in the drawings, wherein.

Figure 1:
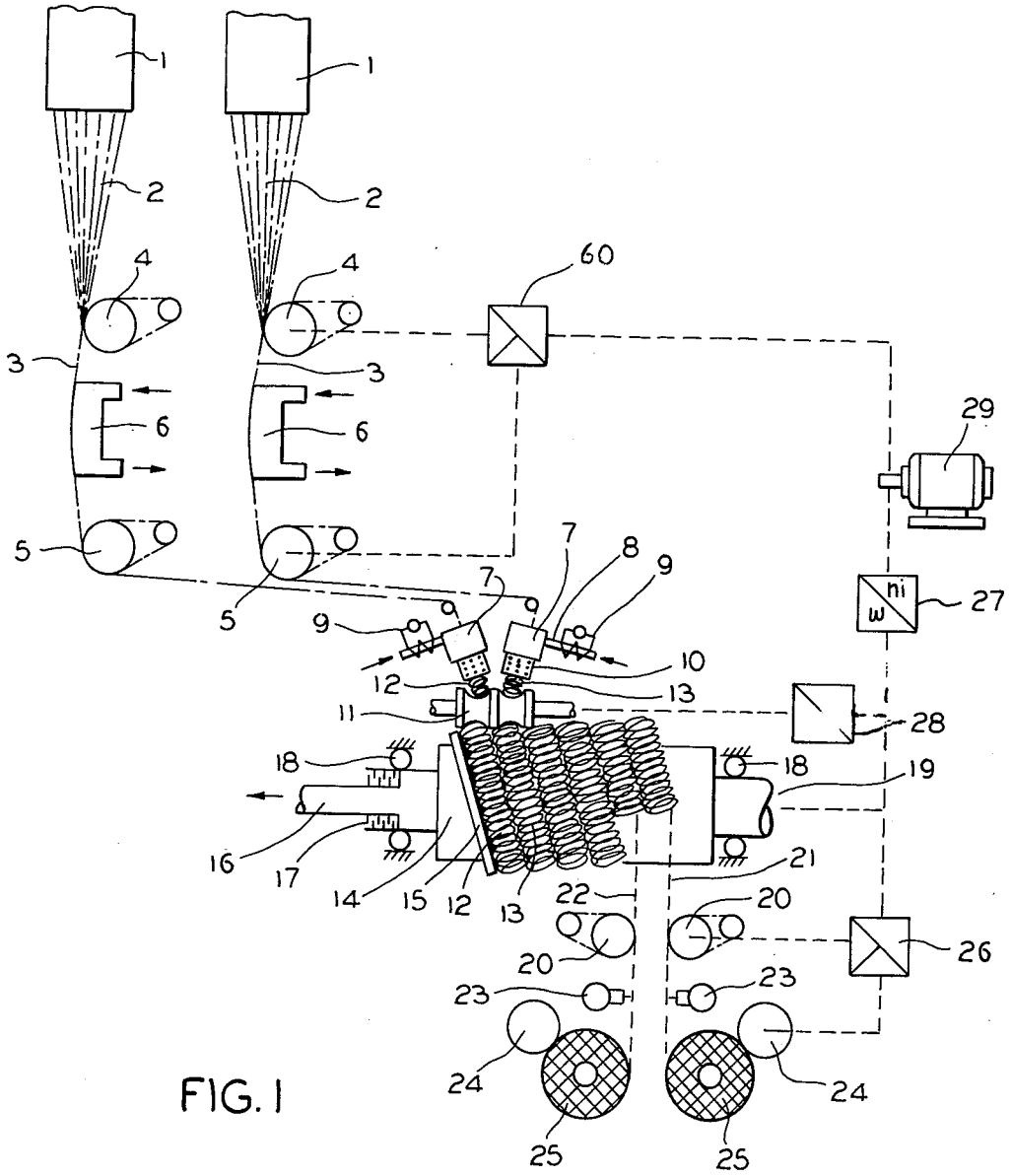
FIG. 1 is a diagrammatic illustation of a texturizing process and of the corresponding apparatus parts embodying thermal treatment according to this invention.

According to FIG. 1 the capillaries 2 are spun in the spinning shaft 1 and combined into a multifile filament 3 composed of capillaries 2. The filament 3 is drawn off through the godet 4 and stretched between the godets 4 and 5 while heated by heating unit 6. In the embodiment illustrated, two filaments are spun parallel to one another. The two filaments are then fed to a respective blowing nozzle 7. Each blowing nozzle has an air feed 8 and, if need be, a heating unit 9 to heat the air. In each blowing nozzle the filament is acted upon with a heated gas, vapor or air stream of high velocity and is compressed in the stuffing chamber 10 into a compact, tightly coherently packed filamentary body 12. The diameter and cross section of the body 12 corresponds substantially to that of the stuffing chamber. To start the texturizing process the lower end of the stuffing chamber 10 is closed, whereupon the initial part of the body 12 can form. The chamber 10 is then opened and the tightly coherently packed filamentary body 12 is conveyed continuously at its rate of formation and is fed to the conveyor rolls 11. The conveyor rolls 11 convey the body to a treatment drum 14 which rotates slowly. The coveyor rolls 11 are not necessary to practice the invention, but are used merely in one advantageous embodiment of the invention.

Figure 2:
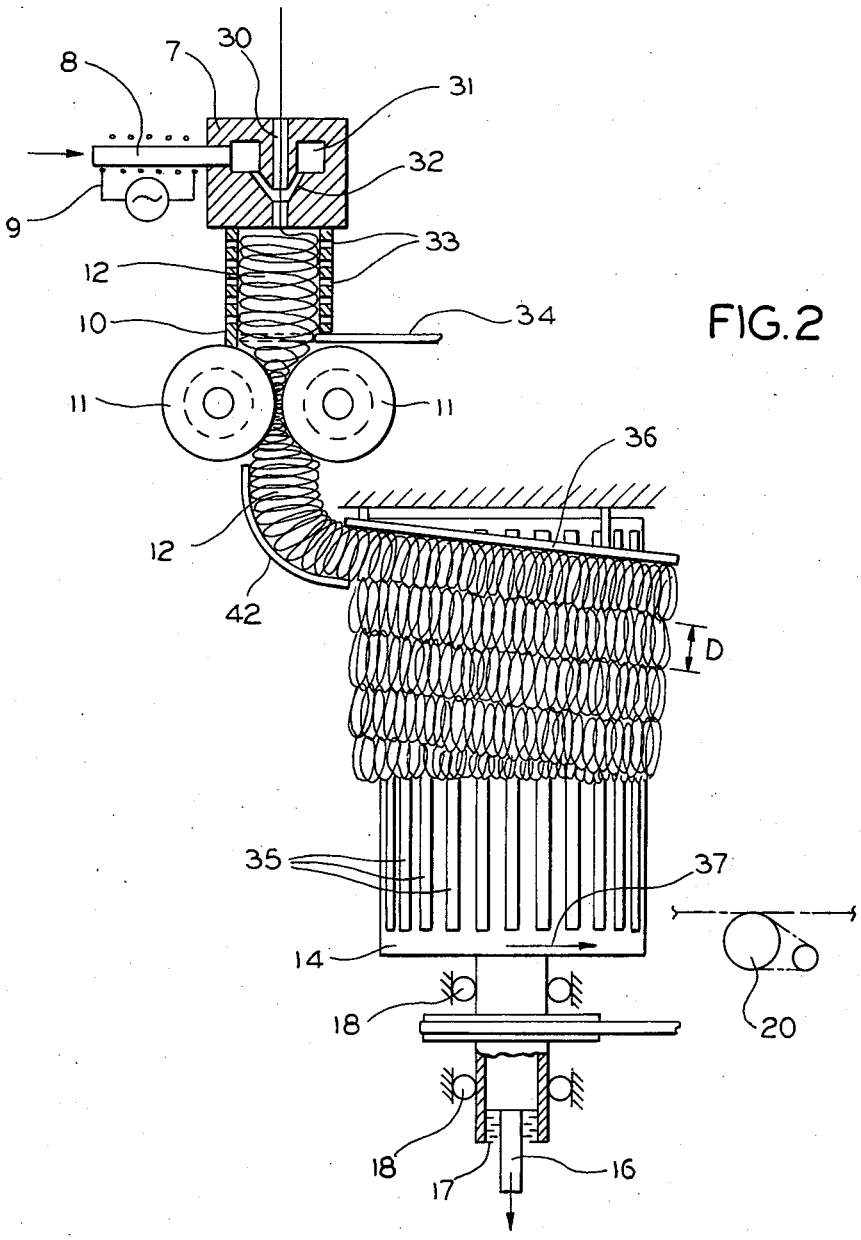
FIG. 2 shows the detailed view of a texturizing nozzle, a stuffing chamber, the conveyor rolls associated therewith and the treatment drum for the thermal treatment according to the invention of the tightly coherently packed filamentary body conveyed thereto by the conveyor rolls.

As FIG. 2 shows in detail (using the reference symbols used also in FIG. 1), the texturizing nozzle consists of a central channel 30 and an annular chamber 31. From the annular chamber 31 is truncated-conical channel 32 extends to the channel 30. The heated medium supplied via feed line 8 and heating unit 9 leads to a plasticizing of the filament and brings about the results that the filament strikes with high kinetic energy against the filamentary body 12 formed in the stuffing chamber. The chamber 10 has openings 33 through which the air can escape from the filamentary body 12.

At the beginning of the texturizing process the chamber 10 is closed by means of the slidable closure valve or shutter 34 until a tightly packed filamentary body 12 has formed. The closure valve (shutter) is then drawn out of the chamber 10 and the filamentary body 12 is conveyed onward at its growth rate out of the chamber 10 and is conveyed onward by the conveyor rolls 11. The conveyor rolls 11 form between them a passage, the cross section of which corresponds substantially to the cross section of the filamentary body. For this purpose the conveyor rolls 11 have on their circumference an essentially semi-circular groove (cf. FIG. 1).

The body 12 conveyed by the conveyor rolls 11 is then deposited in spiral windings on the treatment drum 14. According to FIG. 1 two bodies 12 are generated and texturized parallel to one another. On the treatment drum two windings of tightly coherently packed filamentary bodies 12 and 13 are deposited side-by-side.

The treatment drum 14 is rotatably driven. It has in its cylindrical surface openings 35 which are essentially parallel to the axis of the treatment drum. At its inlet end the treatment drum is surrounded by a feed shoe or plate 36 which is arranged in fixed position on the drum's whole circumference or a part of its circumference. The feed shoe or plate 36 slopes at a pitch angle—as viewed in direction of rotation 37 of the treatment drum—toward the outlet end of the drum. The axial shift of the filamentary body per spiral turn is equal to the diameter D of the filamentary body 12 (FIG. 2), or is equal to the sum of the diameters of the two filamentary bodies 12 and 13 (FIG. 1). If the shoe extends 360° about the circumference of the drum, its pitch is equal to the diameter of the stuffing chamber or is equal to the sum of the diameters of the filamentary bodies. The pitch can, however, also be slightly less than that just specified to bring closely, one upon another, the side-by-side spirals of one or more filamentary bodies 12.

In FIG. 2, contrasted with FIG. 1, only one filament is generated and treated. Further, the tightly compressed filamentary body 12 in FIG. 2 is deflected sharply (90°) by the deflecting baffle 42 before its entry upon the treatment drum, whereby the compaction of the filamentary body 12 is somewhat loosened and the thermal treatment with the gas flowing through the body is facilitated.

The filament bodies are laid at the beginning of the texturizing process in several to many spiral windings about the treatment drum 14 in such a way that the axial zone of the walls over which the openings 35 extend is covered completely or at least almost completely covered, by the spiral windings.

The treatment drum 14 is connected to a vacuum draw-off unit (not represented). Since the treatment drum is hermetically tight except for the openings 35, and since the openings 35 are completely covered by the windings of the filamentary body or bodies, the indrawn air stream, on the one hand, holds the body or bodies fast to the surface of the drum while, on the other hand, said bodies are traversed by the drawn-in gas, e.g., the room air. With room air, the filamentary bodies are thermally treated, i.e., cooled.

To illustrate the openings 35 and further details of the treatment drum, in FIG. 2 the last windings of the filamentary body are omitted. The treatment drum axle is journalled in ball bearings 18. The axle 19 contains a labyrinth 17 joined to the fixed vacuum pipe 16, the latter in turn being connected to vacuum-producing unit (not shown).

On the outlet end of the treatment drum 14 and substantially tangentially to its surface there is a filament draw off unit 20 for each filament 21,22. The filaments 21,22 now texturized and thermally treated (in particular cooled) are drawn off at a rate which is greater than the surface velocity V3 of the texturizing drum 14. The packed filamentary body thereby vanishes at the outlet zone of the treatment drum. The filament(s) are then wound on a winding device or devices. The winding units consist of a traverse mechanism 23, a friction drive roller 24 and the bobbin and winding 25. The winding takes place at filament tension wherein an optimal and desired crimping, if any, of filaments is preserved.

As is to be seen from FIG. 1, the rotating parts, i.e, of the godets 4 and 5, the conveyor rolls 11, the treatment drum 14, the draw-off godets 20 as well as the contact roller 24, are driven off the main drive motor 29 and suitable gears 26, 27, 28 and 60. These gears and their connecting shafts are illustrated symbolically, and the gears are of the adjustable, variable speed type, making it possible to adjust the turning rates of these systems independently of one another. The ratio of the relative rpm of godets 4 and 5 is determined in a known manner according to the desired stretching of the filament.

The conveyance speed of the conveyor rolls 11—hereinafter designated with V2—is considerably lower than the filament speed—hereinafter designated as V1—which is imparted to the filament by the godet 5. For the setting of the circumferential velocity V3 of the treatment drum the following velocity ratio should be employed to prevent any excessive axial pressure in the filament body and a bursting thereof:

$$V3/V1 = 1.42 \times 10^{-4} - (den/P \times \gamma \times D^2)$$

$den$ = denier of the filaments in g/9,000 meters,
$\gamma$ = specific weight of the filaments in kg/1000 cm$^3$
$D$ = diameter of the stuffing chamber in mm
$P$ = packing density of the packed filamentary body.

The packing density of the filamentary body is dependent, for one thing, on the operating parameters of the blowing nozzle of the stuffing chamber. Further, however, the filament properties, such as capillary numbers, capillary forms, mechanical properties such as, resistance to buckling and others are factors to be taken into account. In general, $P<1$.

Depending on the operating parameters used in the blowing nozzle and depending on the filament properties, however, the packing density of the packed filamentary body in the stuffing chamber can become so great that uniform thermal treatment over the entire cross section of the filamentary body is no longer possible. According to the invention, however, as a result of the positive conveyance of the body through the conveyor rolls 11 and by the driven treatment drum 14 a remedy can be provided advantageously by setting a peripheral velocity difference between the conveyor rolls 11 and the treatment drum 14. Thereby, the packing density of the filamentary body and its choke resistance for the flow-through of the gaseous treatment medium is decreased. The upper limit for the peripheral speed of the treatment drum is one which avoids the dissolving or disappearance of the coherently packed filamentary body. To decrease the packing density imparted in the stuffing chamber, the circumferential velocity of the conveyor rolls 11 can be increased, while for the reduction of the packing density on the treatment drum also the circumferential velocity of the conveyor rolls 11 can be reduced. Adjustment of the surface velocity of the treatment drum 14 is accomplished through the variable speed gear 27.

The conveyance speed of the draw-off godets 20 as well as of the friction drive roller 24 is adjusted through gear 26 in such a way that the filamentary body is dissolved at the exit end of the drum. For this the draw-off speed designated in the following as V4—is greater than V3, but less the V1. The determination of V4 has to take into account the contraction of the filaments due to the crimping thereof, if any, in the texturizing and/or thermal treatment, or other properties. Allowance for a certain amount of filament shrinkage ordinarily must be provided so that the properties and in particular the crimping properties will not be impaired while the wound filaments are on the bobbin.

Figure 3:
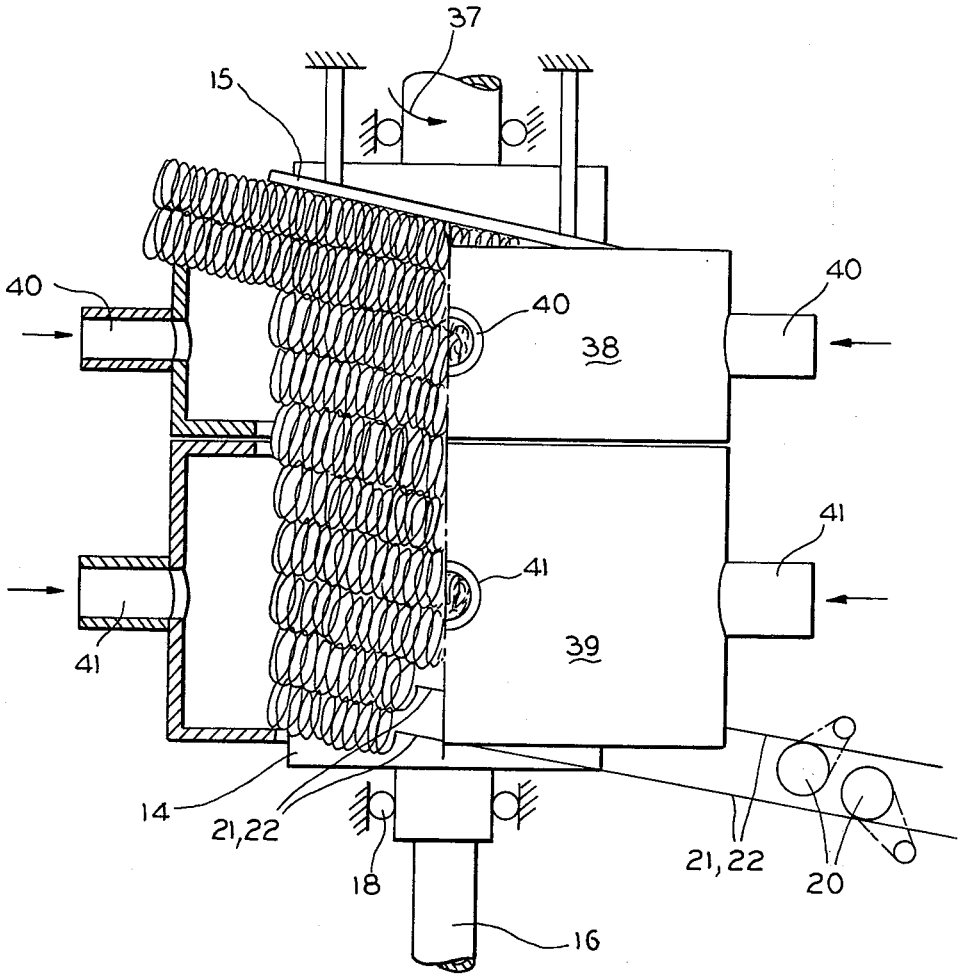
FIG. 3 is a plan view, partly in section, of a treatment drum surrounded by annular chambers.

The thermal treatment of the filamentary body occurs in FIGS. 1 and 2 through the drawing in of room air. There are also, however, cases in which special media, such as, for example, cool steam or aqueous mist or especially tempered media—such as, for example, hot air or hot steam are to be used for the thermal treatment. For this case the treatment drum is surrounded about the zone of its perforated walls by annular chambers into which the treatment media are introduced and which—obviously without touching the coherently packed filamentary body—extend as close as possible to the filamentary body helices about the drum. In FIG. 3, there is shown such a treatment drum 14. Parts identical in function are provided in FIG. 3 with the reference numbers used in FIGS. 1 and 2. The left halves of two annular chambers 38 and 39 are illustrated in section and the right halves in elevation. The first annular chamber 38 may be supplied with hot vapor, especially for the shrinkage treatment of the filaments while the second annular chamber 39 may be supplied with cooling air enriched with water mist. Each annular chamber has at its disposal several gas supply pipes 40,41 to assure a uniform distribution of the treatment medium over the circumference of the treatment drum.

Figure 4:
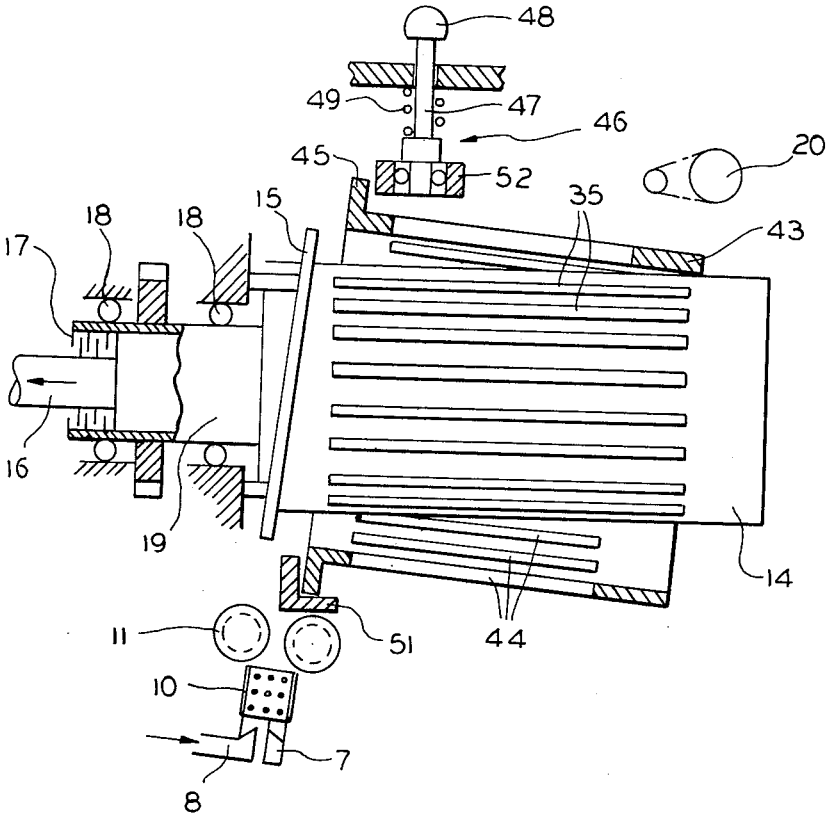
FIG. 4 is a plan view, partly in section, of a treatment drum with a tiltable shell in its rest position about the drum.
Figure 5:
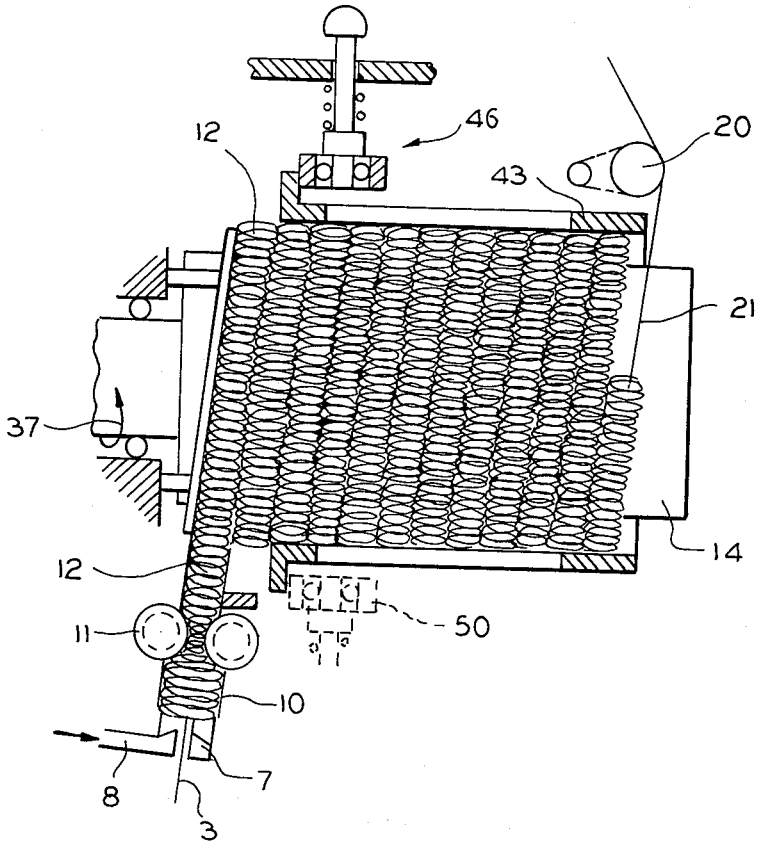
FIG. 5 is a view like that of FIG. 4, but with the shell in the operating position.

The embodiment of FIGS. 4 and 5 corresponds substantially to the apparatus of FIGS. 1 to 3—the apparatus represented in FIG. 4 being at rest and in FIG. 5 in the operating state. At least on a part of the gas-permeable wall of the drum 14, it is surrounded by a shell 43. This shell 43 has openings 44. In the rest position the flange 45 of the shell 43 lies on the fixed support 51 in such a way that the inlet side of the shell 43 is approximately concentric to the treatment drum 14, so that the filamentary body 12 can be fed therebetween. The support 51 on the one hand and the stuffing chamber 10 with conveyor rolls 11 on the other hand are in different planes.

When the body 12, or several filamentary bodies conducted adjacently, is brought onto the treatment drum 14 and wound into a spiral or helical layer, the shell 43, resting on the spiral or helical layer, centers itself. In the process its peripheral flange 45 bears against the axial guide member 52 of the axial guide device 46 to prevent the shell 43 from being carried by the layer in the axial direction. The axial guide device 46, however, is constructed in such a way that it does not bind the shell in a way which prevents the shell from rotating and "floating" on the spiral or helical layer(s).

The axial guide device 46 preferably is a ball bearing mounted on the shaft 47 and whose outer race 52 serves for the guidance of the flange 45. The shaft 47 can be pulled back by hand knob 48 against the pressure of the spring 49 out of engagement with the flange 45. Thereby the shell 43 can be taken off the drum, which is advantageous for the cleaning and especially for the removal of filament residues.

In FIG. 5 a second guide device 50 is illustrated in broken lines. This guide device 50 can be constructed just like the axial guide device 46 or can consist of rotatably journalled rolls distributed about the circumference of the flange or shell. This second axial guide device is not absolutely required.

The guide device 46 or the guide devices 46 and 50 are arranged in such a way that the layers of the filamentary bodies 12 in the annular gap between treatment drum 14 and shell 43 have sufficient space. As FIG. 4 shows, the shell 43—when the treatment unit is not in operation—is tilted, since the flange in this state rests on the support 51. In operation, however, the light and radially shiftable shell allows for the helices or spirals of the filamentary body 12 to have some space for movement, there also being avoided peripheral friction therebetween, since the shell turns along the body.

When no more filaments are supplied, then the feed effect of the feed deflector 15 also ceases. In this case the treatment is stopped in proper time by operating personnel. It is also possible to drive the treatment drum 14 empty, since with absence of axial forward thrust of the filamentary body windings, the filament run-off point moves axially parallel toward the inlet end.

The advantage of the shell 43 lies in that it is autoadjustable with only very little mechanical expenditure, in contrast to the known texturizing device of British Pat. No. 10,82,453, in which the shell is radially clamped and mounted in fixed position. Further, the shell 43 offers over the known arrangement the advantage that the filamentary body 12 is not hampered and remains preserved in the form developed in the stuffing chamber 10, but nevertheless cannot burst apart. Thereby a uniformity of the texturizing process is achieved. For cleaning and, in particular, for removing thread residues, the shell 43 can be taken off without any trouble.

Figure 6:
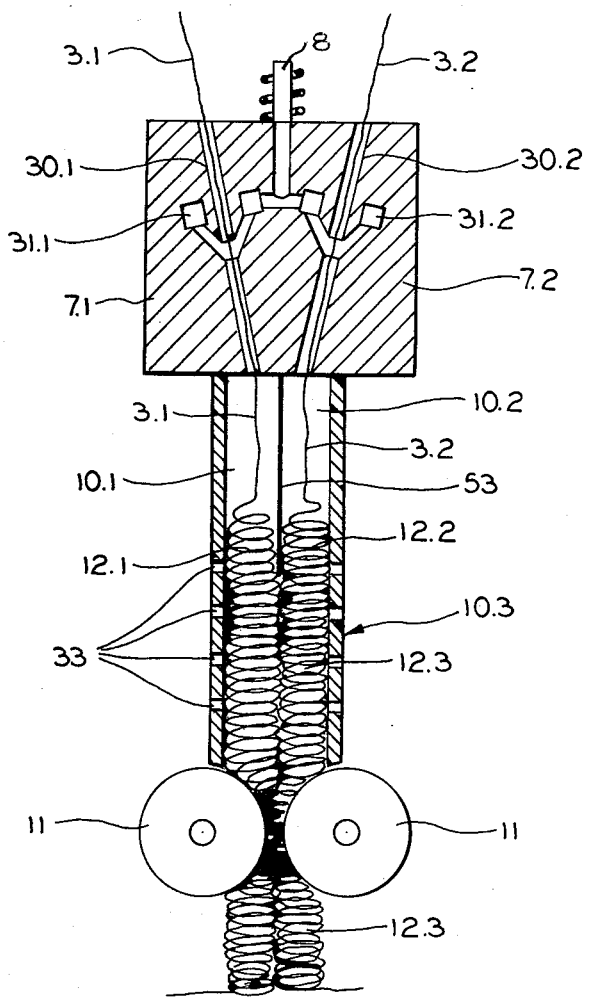
FIG. 6 is a diametric cross section of a stuffing chamber capable of simultaneously forming two filaments into a common tightly coherently packed, filamentary body.

The stuffing chamber shown in FIG. 6 serves for the production of a compositive coherently packed filamentary body 10.3 of two individual filaments 3.1 and 3.2. The stuffing chamber with the two emplaced filament conveyance or texturizing nozzles is essentially constructed exactly like the chamber 10 shown in FIG. 2, with blowing nozzle 7, there being present merely several parts corresponding to the number of filaments.

The blowing nozzles 7.1, 7.2 in FIG. 6 have, accordingly, a common air feed 8. The air feed 8 supplies the two annular channels 31.1 and 31.2 with air. Through corresponding passages 30.1 and 30.2 the filaments 3.1 and 3.2 are acted upon with hot air of high flow energy. Hereby the filaments are conveyed into initial stuffing chambers 10.1 and 10.2. These chambers 10.1 and 10.2 are formed in a common casing. This casing is subdivided toward the inlet side by partition wall 53. Thereby there are formed first of all from each individual filament the filamentary bodies 12.1 and 12.2. The partition 53 extends into the zone in which the air escapes laterally through the openings 33 in the casing. In consequence of the air pressure and the lateral forces in the stuffing chamber the two bodies 12.1 and 12.2 combine into the common compositive filamentary body 12.3. The cross section of this compositive body 12.3 is distinguished in that, to be sure, the two original bodies 12.1 and 12.2 are still present clearly distinct from one another; however, they are in consequence of the pressure exerted on all sides upon the common filamentary body, however, hooked together in such a way that they can be further treated as a single composite body. On the other hand there are no difficulties in resolving the composite filamentary body back into individual filaments at the exit of the treatment drum according to the invention.

There are possible, therefore, a multiplication of the filaments treated simultaneously on a single treatment drum. In the arrangement shown in FIG. 1, therefore, there can be spun simultaneously, for example, four filaments by feeding two filaments to each of the two stuffing chambers constructed according to FIG. 6 and forming into a compositive filamentary body (designated in FIG. 1 in each case with 12 and 13). The bodies 12 and 13 consisting in each case of two filaments are then conducted—as represented in FIG. 1—parallel to one another onto the treatment drum 14, where they are thermally treated and thereupon again resolved again into altogether four individual filaments and wound on four bobbins 25.

The advantage of the treatment apparatus is—as is apparent from the preceding description—to be perceived especially also in that the tension-free thermal treatment of a filament or yarn is made possible without the danger of running into difficulties as otherwise would be the case in the treatment of filaments without tension, especially in the case of high production speeds. Simultaneously, through the many possibilities of speed control and of thermal treatment, there can be attained a sensitive attuning of the treatment process to the textile and process-technology requirements. The formation of the coherently packed filamentary bodies and the thermal treatment thereof may be used to produce crimped filaments or to produce uncrimped filaments, e.g., where the thermal treatment is employed to cool uncrimped filament(s) in the form of a coherently packed filamentary body.

A special advantage attainable with the stuffing chamber of FIG. 6 is found in the configuration of the initial chambers 10.1 and 10.2 and the common stuffing chamber 10.3. The latter has a circular transverse cross-section. The partition wall 53 extends diametrically across the upstream end of this cylindrical chamber, thereby subdividing the upstream end into two initial chambers 10.1 and 10.2 having back-to-back, semi-circular, transverse cross-sections. Thereby, when the filamentary bodies 12.1 and 12.2 enter the common stuffing chamber 10.3 (having a circular cross-section), their contact area are the back-to-back sides of the semi-circular filamentary bodies 12.1 and 12.2. Thus, the side of the filamentary body 12.1 which comes into contact with the side of another filamentary body, i.e., body 12.2, has a rectilinear configuration as contrasted with the circular configurations of the sides which interengage in embodiments like those of FIG. 3. It is of further advantage that the sum of the transverse cross-sectional areas of the initial chambers 10.1 and 10.2 be the same as or somewhat greater than the transverse cross-sectional area of the common stuffing chamber 10.3.

It is thought that the invention and its numerous attendant advantages will be fully understood from the foregoing description, and it is obvious that numerous changes may be made in the form, construction and arrangement of the several parts without departing from the spirit or scope of the invention, the forms herein disclosed being preferred embodiments for the purpose of illustrating the invention.

The invention is hereby claimed as follows:

1. A process for the thermal texturizing treatment of multifile filaments of thermoplastic synthetic polymers which comprises feeding at least one multifile filament into a stuffing chamber and herein forming a closely packed, coherent filamentary body, conveying said tightly packed, coherent filamentary body from said chamber substantially tangentially onto the surface of a gas-permeable, rotating drum at the entrant zone thereof by rotating means engaging the exterior of said body and providing a positive axial thrust to said filamentary body between said stuffing chamber and said entrant zone of said drum, imparting a thrust to said body in the axial direction of said drum as it moves onto the drum surface, forming spiral convolutions of said filamentary body about the gas-permeable drum whereby rotation of said drum moves said spiral convolutions axially from the entrant zone on said drum to an exit zone thereon, passing a gas through the spirally convoluted, filamentary body and the gas permeable surface of said drum, and withdrawing the multifile filament from said exit zone at a speed sufficient to dissolve the coherently packed filamentary body.

2. A process as claimed in claim 1 which further comprises forming at least two of said coherently packed filamentary bodies in a corresponding number of stuffing chambers situated next to one another, conveying the respective filamentary bodies from the respective chambers onto the surface of said gas permeable, rotating drum with said filamentary bodies lying side-by-side on the surface of said drum and forming respective, side-by-side, spiral convolutions about the gas permeable drum in a manner substantially covering the entire perforated portion of said drum whereby rotation of said drum moves the respective spiral convolutions of the respective filamentary bodies axially from the entrant zone of said drum to the exit zone thereof.

3. A process as claimed in claim 1 wherein said drum is rotated at a circumferential velocity V3 which is less than the multifile filament velocity V1 at which the multifile filaments are conducted into the chamber, said velocities V3 and V1 having a relationship expressed by the formula:

$$V3/V1 = 1.42 \cdot 10^{-4} (den/P\,\gamma\,D^2)$$

in which $den$ = denier of the multifile filaments in g/9,000 meters $\gamma$ = specific weight of the multifile filaments in kg/1000 cm$^3$ $D$ = diameter of the chamber in mm $P$ = packing density of the coherently packed multifile filaments with $P < 1$.

4. A process as claimed in claim 1 wherein said drum is rotated at a circumferential velocity V3 which is greater than that set forth for the relationship between V3 and V1 according to the equation in claim 3, and said circumferential velocity being sufficient to reduce the packing density of the filamentary body which would be otherwise achieved in the stuffing chamber absent said greater circumferential velocity V3 such that the coherence of said body remains undisturbed, while the gas permeability of said body is increased.

5. A process as claimed in claim 1, wherein atmospheric air at ambient temperature is drawn through the spirally convoluted filamentary body into the gas permeable drum.

6. A process as claimed in claim 1, and drawing in at least two different treatment gases in respective annular, axially successive zones about the drum through the spiral convolutions of said filamentary body into the gas permeable drum.

7. A process as claimed in claim 1 wherein the multifile filament is withdrawn from said exit zone of said drum at a velocity V4 which is less than the velocity V1 at which the multifile filament is fed to the stuffing chamber under conditions wherein the circumferential velocity V3 of said drum is less than both V4 and V1 and V4 equals K × V1 wherein K equals the contraction of the withdrawn multifile filament.

8. A process as claimed in claim 1 wherein said coherently packed filamentary body is axially bent by deflecting said body just before or during its movement onto the rotating drum surface.

9. A process as claimed in claim 8 wherein said filamentary body is initially supplied to the drum in a direction axially parallel to the drum's axis of rotation and thereafter said filamentary body is deflected onto the surface of said drum at a pitch angle which causes said filamentary body to form said spiral convolutions.

10. A process as claimed in claim 1 wherein the transverse cross-section of the filamentary body fed to said drum is a square cross-section.

11. A process as claimed in claim 1, forming a plurality of individual, separate, packed filamentary bodies of respective multifile filaments in a plurality of initial chambers, conveying said bodies into a common stuffing chamber wherein said bodies come into contact with each other and form a common, composite body of the filamentary bodies, conveying said composite body at a constant velocity V2 out of said common stuffing chamber and onto the surface of said gas permeable, rotating drum on which side-by-side, spiral convolutions of said composite body are formed between the entrant and exit zones of said drum, and resolving the composite body into separate, respective multifile filaments at the exit zone of said drum.

12. A process as claimed in claim 11 wherein the respective, separate filamentary bodies are shaped with respective transverse cross-sections having a rectilinear configuration along the side of each which comes into contact with another of said filamentary bodies in said common stuffing chamber.

13. A process as claimed in claim 11 wherein two, separate, filamentary bodies of semi-circular transverse cross-sections are formed, and the rectilinear sides of said semi-circular bodies are brought into contact in said common stuffing chamber to form a composite body thereof having a circular cross-section.

14. A process as claimed in claim 11, wherein the respective multifile filaments for each of said initial chambers are fed by compressed air into the respective initial chambers, and forming said composite body of the individual filamentary bodies while or upon allowing said air to escape from said common stuffing chamber.

15. An apparatus for the thermal texturizing treatment of multifile filaments of thermoplastic, synthetic polymers, which comprises at least one stuffing chamber adapted for texturizing of said filaments, means for feeding at least one multifile filament at a high velocity into the stuffing chamber to form therein a tightly coherently packed, filamentary body, a rotatable drum having a cylindrical or slightly conically tapered surface, at least a portion of which is gas-permeable, a pair of opposed, rotatably driven conveyor rollers between said packing chamber and said drum for engaging therebetween the filamentary body and imparting thereto a positive conveyance to the filamentary body, and guide means for conveying said filamentary body onto said surface of said rotating drum at a pitch angle which causes said filamentary body or bodies to form side-by-side spiral convolutions on said surface of said rotating drum.

16. Apparatus as claimed in claim 15, wherein said stuffing chamber or chambers and the filamentary body formed by each have a circular cross-section, and said pitch angle provides a pitch length, axially along the surface of said drum, which is equal to or less than the diameter of said stuffing chamber or the sum of the respective diameters of a plurality of said chambers.

17. Apparatus as claimed in claim 15, wherein said stuffing chamber or chambers and the filamentary body formed by each have a square cross-section, and said pitch angle provides a pitch length, axially along the surface of said drum, which is equal to or less than the side length of said stuffing chamber or the sum of the respective side lengths of a plurality of said chambers.

18. Apparatus as claimed in claim 15, a freely rotatable substantially cylindrical, gas-permeable shell surrounding at least a portion of said drum, and the shell being adapted, in its operating position, to rest upon the spiral convolutions of said filamentary body or bodies and being rotated by the spiral convolutions, and the inside diameter of said shell being equal to, or slightly larger or smaller than, the outer diameter of said spiral convolutions.

19. Apparatus as claimed in claim 18, and support means for supporting said shell in its operating position to preclude axial displacement of said shell relative to said drum while allowing said shell to move radially relative to said drum.

20. Apparatus as claimed in claim 19, wherein said support means comprises at least one roll or bearing surface riding against a flange projecting radially from said shell.

21. Apparatus as claimed in claim 19, said support means embodying retractable means permitting disengagement of said shell from said support means to permit removal of said shell from said drum.

22. Apparatus as claimed in claim 18, and support means at the entrant end of said shell for approximately centering said entrant end of said shell relative to said drum during the initial feed of said filamentary body or bodies onto said drum's surface.

23. Apparatus as claimed in claim 15, said stuffing chamber comprising at least two initial chambers into which respective multifile filaments are fed, the outlet ends of said initial chambers opening into a common stuffing chamber, and the sum of the transverse cross-section areas of said initial chambers being somewhat greater than or equal to the transverse cross-section area of said common stuffing chamber.

24. Apparatus as claimed in claim 23, and a blowing nozzle for each initial chamber for feeding a respective multifile filament thereto at high velocity.

25. Apparatus as claimed in claim 23 wherein said common stuffing chamber has one end thereof subdivided by partition wall means to form two or more of said initial chambers.

26. Apparatus as claimed in claim 25 wherein the side wall of said common stuffing chamber has lateral openings for escape of air from said chamber.

27. Apparatus as claimed in claim 15, two or more annular chambers surrounding axially successive portions of said drum, each chamber having gas passage means facing and in close proximity to the drum surface, and means for supplying a respective thermal treatment gas or vapor to each chamber for flow thereof out of said gas passage means through said spiral convolutions and into said drum.

* * * * *

UNITED STATES PATENT AND TRADEMARK OFFICE

CERTIFICATE OF CORRECTION

PATENT NO. : 4,118,843

DATED : October 10, 1978

INVENTOR(S) : Schippers et al

It is certified that error appears in the above-identified patent and that said Letters Patent are hereby corrected as shown below:

On the front page of the patent, the following should be inserted between [22] and [51]:

[30] Foreign Application Priority Data

July 16, 1976 Fed. Rep. of Germany ..... 2632082
and
Aug. 21, 1976 Fed. Rep. of Germany ..... 2637746

Signed and Sealed this

*Fourteenth* Day of *August 1979*

[SEAL]

*Attest:*

*Attesting Officer*

LUTRELLE F. PARKER

*Acting Commissioner of Patents and Trademarks*